US010758103B2

(12) United States Patent
Park et al.

(10) Patent No.: US 10,758,103 B2
(45) Date of Patent: Sep. 1, 2020

(54) ROBOT CLEANER AND CONTROLLING METHOD THEREOF

(71) Applicant: LG ELECTRONICS INC., Seoul (KR)

(72) Inventors: Jeongseop Park, Seoul (KR); Sungho Yoon, Seoul (KR); Jaewon Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/057,394

(22) Filed: Aug. 7, 2018

(65) Prior Publication Data

US 2019/0038105 A1 Feb. 7, 2019

(30) Foreign Application Priority Data

Aug. 7, 2017 (KR) ..... 10-2017-0099753

(51) Int. Cl.
*A47L 11/40* (2006.01)
*A47L 11/282* (2006.01)
(Continued)

(52) U.S. Cl.
CPC ..... *A47L 11/4011* (2013.01); *A47L 9/28* (2013.01); *A47L 9/2805* (2013.01); *A47L 11/161* (2013.01); *A47L 11/282* (2013.01); *A47L 11/305* (2013.01); *A47L 11/4002* (2013.01); *A47L 11/4066* (2013.01);
(Continued)

(58) Field of Classification Search
CPC ..... E01H 1/103; B08B 5/04; B08B 3/024; A47L 2201/04; A47L 11/00; A47L 2201/00; B05B 15/60
See application file for complete search history.

(56) References Cited

U.S. PATENT DOCUMENTS

2004/0143927 A1 7/2004 Haegermarck et al.
2004/0181896 A1 9/2004 Egawa et al.
(Continued)

FOREIGN PATENT DOCUMENTS

EP 1 762 165 3/2007
JP H10-211132 8/1998
(Continued)

OTHER PUBLICATIONS

European Search Report dated Nov. 16, 2018 issued in EP Application No. 18187634.3.
(Continued)

*Primary Examiner* — David Redding
(74) *Attorney, Agent, or Firm* — Ked & Associates, LLP

(57) ABSTRACT

The present application relates to a robot cleaner. The robot cleaner of the present application includes: a main body which forms an external shape; a water tank which stores water; a rotation mop which is in contact with a floor while rotating and moves the main body; a drive motor which rotates the rotation mop; a motion detection unit which measures a reference motion of the main body when the rotation mop rotates; and a controller which measures a slip rate based on an actual speed of the main body measured by the motion detection unit in the reference motion and an ideal speed of the main body estimated according to driving of the drive motor, and controls an amount of water supplied to the rotation mop.

24 Claims, 12 Drawing Sheets

(51) Int. Cl.

| | |
|---|---|
| ***A47L 11/30*** | (2006.01) |
| ***A47L 11/16*** | (2006.01) |
| ***A47L 9/28*** | (2006.01) |

(52) U.S. Cl.
CPC ..... *A47L 11/4083* (2013.01); *A47L 2201/00* (2013.01); *A47L 2201/06* (2013.01)

(56) References Cited

U.S. PATENT DOCUMENTS

| | | | |
|---|---|---|---|
| 2005/0015913 | A1 | 1/2005 | Kim et al. |
| 2006/0185690 | A1 | 8/2006 | Song et al. |
| 2007/0051757 | A1 | 3/2007 | Lim et al. |
| 2008/0276407 | A1 | 11/2008 | Schnittman et al. |
| 2012/0168971 | A1 | 7/2012 | Hansen et al. |
| 2012/0169497 | A1 | 7/2012 | Schnittman et al. |
| 2012/0222706 | A1 | 9/2012 | Pears et al. |
| 2014/0196247 | A1 | 7/2014 | Kasper |
| 2014/0259478 | A1 | 9/2014 | Conrad |
| 2015/0182090 | A1 | 7/2015 | Park et al. |
| 2015/0223653 | A1 | 8/2015 | Kim et al. |

FOREIGN PATENT DOCUMENTS

| | | |
|---|---|---|
| JP | 2014-014455 | 1/2014 |
| JP | 2014-137694 | 7/2014 |
| JP | 2015-163153 | 9/2015 |
| KR | 20-1988-0011603 | 8/1998 |
| KR | 10-0241620 | 4/2000 |
| KR | 10-2005-0012047 | 1/2005 |
| KR | 20-0395016 | 9/2005 |
| KR | 20-0437646 | 12/2007 |
| KR | 10-0814507 | 3/2008 |
| KR | 10-2008-0040761 | 5/2008 |
| KR | 10-0835968 | 6/2008 |
| KR | 10-2008-0081626 | 9/2008 |
| KR | 10-0871114 | 11/2008 |
| KR | 10-2010-0076134 | 7/2010 |
| KR | 10-1026003 | 3/2011 |
| KR | 20-0458863 | 3/2012 |
| KR | 10-2012-0069845 | 6/2012 |
| KR | 10-1152720 | 6/2012 |
| KR | 10-1164291 | 7/2012 |
| KR | 10-2012-0129185 | 11/2012 |
| KR | 10-1323597 | 11/2013 |
| KR | 10-1338143 | 12/2013 |
| KR | 10-2014-0011216 | 1/2014 |
| KR | 10-1369220 | 3/2014 |
| KR | 10-2014-0060450 | 5/2014 |
| KR | 10-1487778 | 1/2015 |
| KR | 10-2015-0014351 | 2/2015 |
| KR | 10-1495866 | 2/2015 |
| KR | 10-2015-0057959 | 5/2015 |
| KR | 10-1519685 | 5/2015 |
| KR | 10-2015-0073726 | 7/2015 |
| KR | 10-2015-0078094 | 7/2015 |
| KR | 10-2015-0095469 | 8/2015 |
| KR | 10-1543490 | 8/2015 |
| KR | 10-1544667 | 8/2015 |
| KR | 10-2015-0139111 | 12/2015 |
| KR | 10-1578879 | 12/2015 |
| KR | 10-1602790 | 3/2016 |
| KR | 10-2016-0090567 | 8/2016 |
| KR | 10-2016-0090571 | 8/2016 |
| KR | 10-1654014 | 9/2016 |
| KR | 10-2017-0049532 | 5/2017 |
| KR | 10-2017-0124216 | 11/2017 |
| KR | 10-2018-0008250 | 1/2018 |

OTHER PUBLICATIONS

International Search Report dated Dec. 4, 2018 issued in PCT/KR2018/008928.
International Search Report dated Dec. 7, 2018 issued in PCT/KR2018/008922.
International Search Report dated Dec. 10, 2018 issued in PCT/KR2018/008954 (English translation).
International Search Report dated May 22, 2019 issued in PCT/KR2019/001021.
United States Office Action dated Apr. 24, 2020 issued in U.S. Appl. No. 16/057,492.
U.S. Appl. No. 16/057,394, filed Aug. 7, 2018.
U.S. Appl. No. 16/057,448, filed Aug. 7, 2018.
U.S. Appl. No. 16/057,492, filed Aug. 7, 2018.
U.S. Appl. No. 16/256,435, filed Jan. 24, 2019.
U.S. Appl. No. 16/057,516, filed Aug. 7, 2018.
U.S. Appl. No. 16/057,076, filed Aug. 7, 2018.
U.S. Appl. No. 16/056,971, filed Aug. 7, 2018.
U.S. Appl. No. 16/057,550, filed Aug. 7, 2018.
U.S. Appl. No. 16/057,572, filed Aug. 7, 2018.
United States Notice of Allowance dated May 11, 2020 issued in U.S. Appl. No. 16/057,572.
Korean Office Action dated Apr. 22, 2020 issued in KR Application No. 10-2019-0124685.
United States Office Action dated Jun. 17, 2020 issued in co-pending related U.S. Appl. No. 16/057,550.

ROBOT CLEANER AND CONTROLLING METHOD THEREOF

CROSS-REFERENCE TO RELATED APPLICATION(S)

This application claims priority under 35 U.S.C. § 119 to Korean Application No. 10-2017-0099753 filed on Aug. 7, 2017, whose entire disclosure is hereby incorporated by reference.

BACKGROUND

1. Field

The present application relates to controlling a robot cleaner and, more particularly, to controlling a robot cleaner having a rotation mop.

2. Background

The use of robots in the home has gradually expanded. One example of such a household robot is a cleaning robot (also referred to herein as an autonomous cleaner). The cleaning robot is a mobile robot that travels autonomously along a floor within a certain region and may automatically perform cleaning while moving within the region. For example, a robot vacuum cleaner may automatically suction foreign substances, such as dust accumulated on the floor, or may clean the floor using a mopping device. A cleaning robot that includes a rotating mop (also referred to herein as a rotation mop) may move based on the rotation of the mop. In addition, the mop may include a cloth or other cleaning surface, and the robot cleaner may supply water to the rotation mop to dampen the cleaning surface such that the wet cleaning surface contacts and cleans the floor.

Korean Patent Registration No. 10-1578879 describes a cleaning mobile robot that moves and cleans a floor surface using a rotation mop. However, this reference does not discuss controlling a water supply rate to the rotation mop of the mobile cleaning robot. If the water supplied to the rotation mop is not appropriately adjusted and the rotation mop receives excess water, the rotation mop may deposit the excess water on the floor to be cleaned, preventing the floor from being properly cleaned and leading to potentially unsafe wet floors. If the rotation mop receives insufficient amounts of water, the rotation mop may contact the floor with a relatively dry cloth such that the floor is not properly cleaned. Furthermore improper adjustment of the water supplied to the rotation mop is may prevent the robot cleaner from moving correctly and efficiently.

BRIEF DESCRIPTION OF THE DRAWINGS

Embodiments will be described in detail with reference to the following drawings in which like reference numerals refer to like elements, and wherein.

DETAILED DESCRIPTION

Figure 1:
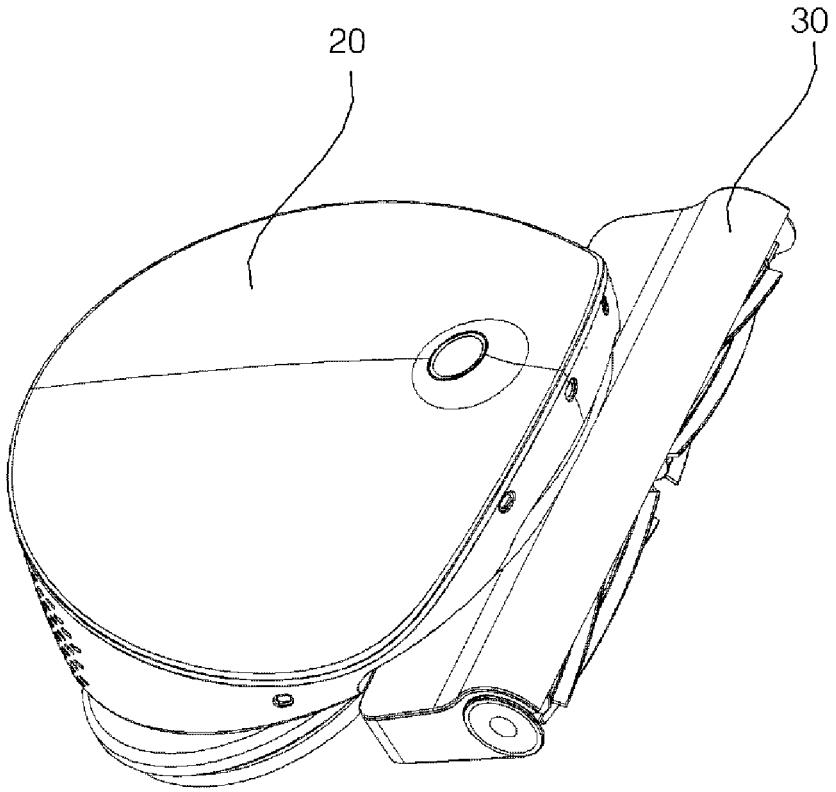
FIG. 1 is a perspective view of a robot cleaner according to an embodiment of the present application.
Figure 2:
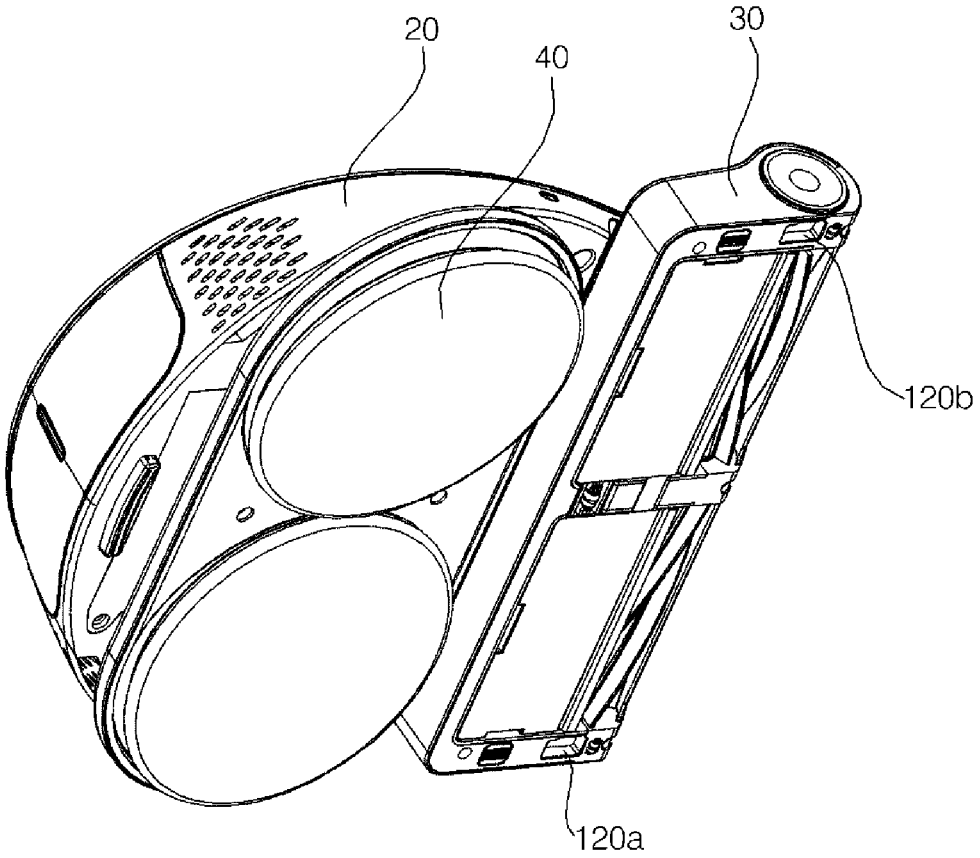
FIG. 2 is a bottom perspective view of a robot cleaner according to an embodiment of the present application.

Exemplary embodiments of the present application are described with reference to the accompanying drawings in detail. The same reference numbers are used throughout the drawings to refer to the same or like parts. Detailed descriptions of well-known functions and structures incorporated herein may be omitted to avoid obscuring the subject matter of the present application. Hereinafter, the present application will be described with reference to the drawings for explaining a control method of a robot cleaner according to embodiments of the present application.

Referring to FIG. 1 to FIG. 4, a configuration of a robot cleaner 10 that performs motion by rotation of a mop according to certain embodiments will be briefly described. The robot cleaner 10 according to certain embodiments may include a main body 20 that forms an outer shape of the robot cleaner 10, a rotation mop that moves the main body 20 along a floor surface, and a drive motor 38 that may drive the rotation of the rotation mop.

The rotation mop used in the robot cleaner 10 may be equipped with a mop pad or other surface that contacts a floor and that includes a microfiber or a fabric material. Therefore, during the rotation of the rotation mop 40, a slip may occur in which the robot cleaner 10 cannot move in comparison with the actual rotation of the rotation mop since the microfiber or a fabric material of the mop pad may generate a relatively small friction force.

In certain examples, the rotation mop 40 may include a rolling mop driven along a rotational axis that is substantially parallel to the floor or a spin mop 40 driven along a rotational axis that is substantially perpendicular to the floor. Hereinafter, a slip rate may be calculated for the spin mop 40 (e.g., the rotation mop having the rotational axis that is substantially perpendicular to the floor), and a water content rate (e.g., moisture level) of the spin mop 40 may be measured.

As used herein, the slip rate may refer to the degree of a slip that occurs as the spin mop rotates on the floor surface. A slip of rate of zero ('0') indicates that the robot cleaner 10 is moving at an ideal rotation speed in which the actual rotation speed corresponds to a desired rotation speed. In addition, the water content rate may refer to a degree to which the spin mop 40 contains water, and a water content rate value of zero ('0') corresponds to when relatively no water is contained in the spin mop 40. The water content rate according to the present embodiment may be set as a ratio of water contained in the spin mop 40 (e.g., a difference between a weight of the wet spin mop 40 and the dry spin mop 40) to the weight of the spin mop 40. The spin mop 40 may, for example, contain water of a same weight as the spin mop or may even contain water of a weight in excess of the weight of the mop pad.

The slip rate may vary depending on a water content rate corresponding to a degree that the rotation mop contains water. As the rotation mop holds more water, a friction force for the floor surface may increase due to the influence of water, thereby reducing the slip rate. The relationship between the slip rate and the water content rate may be experimentally determined, and may be stored as data in a storage unit (or memory) 130 described below. In addition, the relationship between the slip rate and the water content rate may vary depending on one or more attributes of the floor, such as a material, smoothness, hardness, etc. of the floor, which may also be experimentally determined and stored in the storage unit 130 as data.

The robot cleaner 10 according to the one embodiment may include a water tank 32 that is provided inside the main body 20 to store water, a pump 34 that supplies water stored in the water tank 32 to the spin mop 40, and a connection hose 36 that forms a connection path connecting the pump 34 and the water tank 32 or connecting the pump 34 and the spin mop 40. The robot cleaner 10 according to one embodiment may supply the water stored in the water tank 32 to the spin mop 40 using a water supply valve (not shown) and without a separate pump. For example, the water within the water tank 32 may flow downward toward the spin mop 40 due to gravity, and the water supply valve may control this downward flow. In certain examples, the connection hose 36 may be formed as a connection pipe or may be directly connected to the spin mop 40 from the water tank 32 without a separate connection path.

The robot cleaner 10 according to one embodiment may include a pair of spin mops 40. The robot cleaner 10 may travel due to the respective rotations of the pair of spin mops 40, as described in greater below with respect to FIGS. 6A-6C. For example, the robot cleaner 10 may control travel by varying the rotational direction and/or rotation speed of each of the pair of spin mops 40. The robot cleaner 10 according to one embodiment may further include a cleaning module (or cleaning head) 30 which is positioned in front of the spin mop 40 and removes foreign substances from a floor surface before the spin mop 40 wipes the floor surface with a damp cloth.

Figure 3:
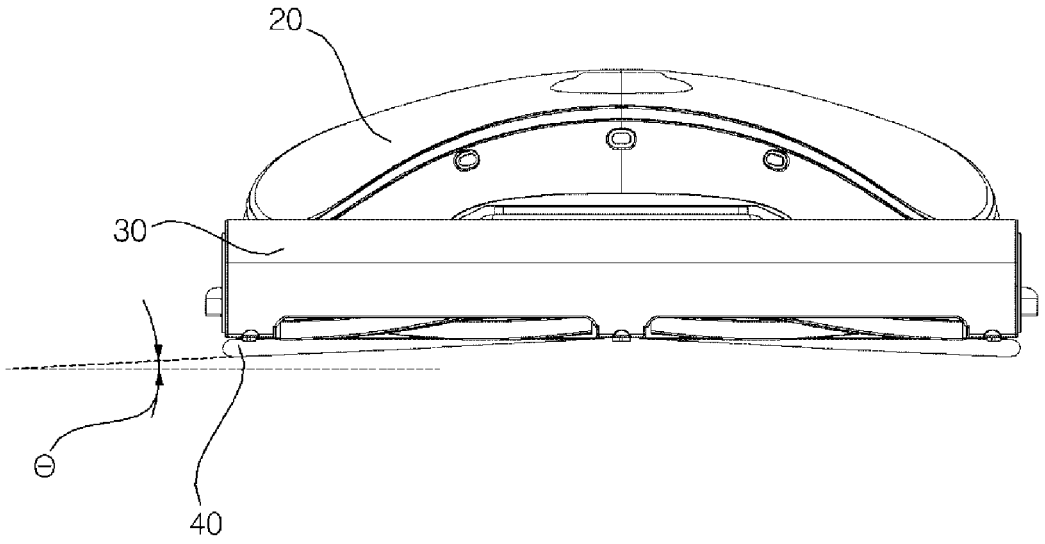
FIG. 3 is a front view of a robot cleaner according to an embodiment of the present application.
Figure 4:
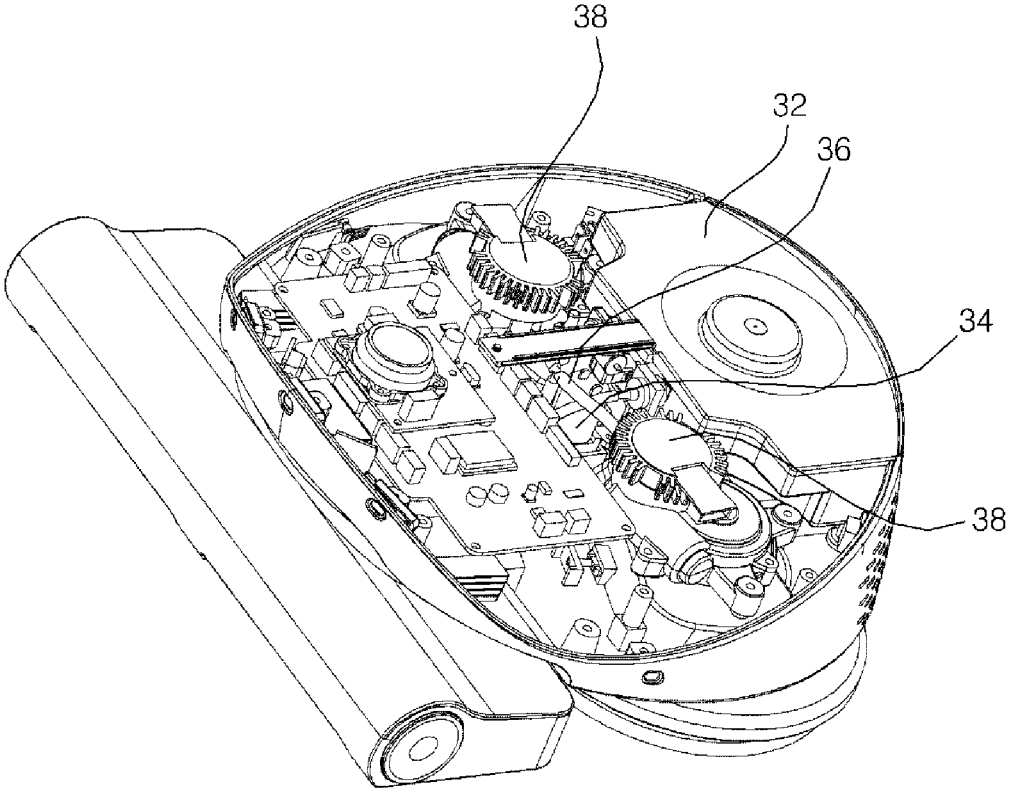
FIG. 4 is a view for explaining an internal configuration of a robot cleaner according to an embodiment of the present application.

Referring to FIG. 3, the robot cleaner 10 according to one embodiment may be arranged in such a manner that the spin mop 40 is inclined by a certain angle θ relative the floor surface. In order to facilitate the movement of the robot cleaner 10, the spin mops 40 may be arranged in such a manner that the entire surface of each of the spin mop 40 do not evenly contact the floor surface but, instead, is tilted by a certain angle θ so that a certain portion of the spin mop is mainly in contact with the floor surface. In addition, the spin mop 40 may be positioned in such a manner that the most friction force is generated at a certain portion of the spin mop 40 even if the entire surface of the spin mop 40 is in contact with the floor surface. For example, the spin mop 40 may be positioned such that the portion of the spin mop 40 supports a relatively larger portion of a weight of the robot cleaner 10.

Figure 5:
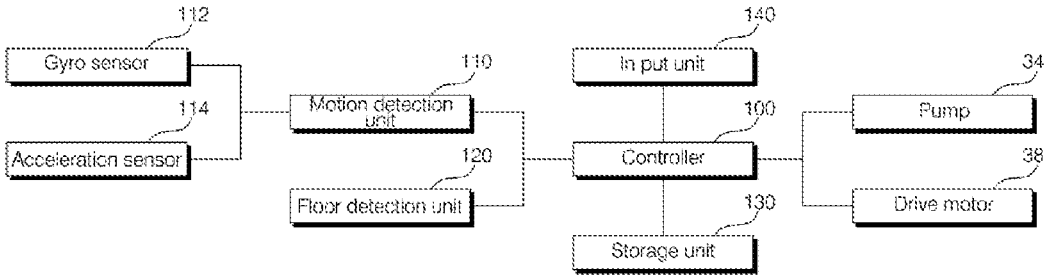
FIG. 5 is a block diagram illustrating a controller of a robot cleaner and a configuration relating to the controller according to an embodiment of the present application.

FIG. 5 is a block diagram illustrating a controller of a robot cleaner and a configuration relating to the controller according to an embodiment of the present application. The robot cleaner 10 according to one embodiment may further include a motion detection unit (or motion sensor) 110 that senses a motion of the robot cleaner 10 according to a reference motion of the main body 20 when the spin mop 40 rotates. The motion detection unit 110 may further include a gyroscopic (or gyro) sensor 112 that detects the rotation speed of the robot 10 or an acceleration sensor 114 that senses an acceleration of the robot cleaner 10. In addition, the motion detection unit 110 may include or may communicate with an encoder (not shown) that senses a moving distance of the robot cleaner 10.

A reference motion in the present embodiment may be a motion when driving the spin mop 40 of the robot cleaner 10. The slip rate of the robot cleaner 10 may be calculated by using at least one of the gyro sensor 112 or the acceleration sensor 114 when the spin mop 40 of the robot cleaner 10 is driven. The motion may be divided into a static motion in which the robot cleaner 10 rotates in place and a moving motion in which the robot cleaner 10 performs a straight movement or a turning movement.

The gyro sensor 112 may be a sensor that senses the rotation of the robot cleaner 10. In one embodiment, the gyro sensor 112 may measure, as the reference motion, an actual rotation speed of the robot cleaner 10 when the robot cleaner 10 rotates in place or turns to move in a curved path.

The acceleration sensor 114 may be a sensor that senses a straight movement acceleration of the robot cleaner 10. In one embodiment, in the acceleration sensor 114 may measure, as the reference motion, an actual speed of the robot cleaner 10 when the robot cleaner 10 moves straight. The encoder may include a sensor that senses a moving distance of the robot cleaner 10 and may measure the actual speed of the robot cleaner 10 when the robot cleaner 10 moves in the reference motion.

The robot cleaner 10 according to one embodiment may further include a floor detection unit (or floor sensor) 120 that detects information regarding a floor surface on which the robot cleaner moves. For example, the floor detection unit 120 may detect information related to classifying a type of material of the floor surface on which the robot cleaner 10 moves as marble or other hard floor, carpet, or the like.

The floor detection unit 120 may determine an attribute of the material of the floor based on sensing a current provided to the drive motor 38. For example, the floor detection unit 120 may determine a relative smoothness and hardness of the floor based on an efficiency at which the drive motor 38 moves the robot cleaner 10. In addition, the floor detection unit 120 may include a light source and an image sensor or camera, and the image sensor may obtain image information corresponding to a reflection of light from the light source. The obtained images may be compared or otherwise processed to determine the material of the floor.

The robot cleaner 10 may include a cliff sensor 120*a*, 120*b* (see FIG. 2) that sense a presence or absence of a cliff on the floor in the cleaning area. The robot cleaner 10 according to the present embodiment may include a plurality of cliff sensors 120*a*, 120*b*. The cliff sensors 120*a*, 120*b* according to the present embodiment may be disposed in a front portion of the robot cleaner 10.

The cliff sensor 120*a*, 120*b* according to one embodiment may include at least one light emitting element (or light emitter) and at least one light receiving element (or light sensor). The cliff sensor 120*a*, 120*b* may be used as the floor detection unit 120. For example, a controller 100 may determine the material of the floor based on the amount of reflected light which is outputted from the light emitting element, reflected from the floor, and subsequently received by the light receiving element.

For example, when an amount of the reflected light is equal to or greater than a certain value, the controller 100 may determine that the floor as a hard floor (e.g., includes wood, stone, or tile), and if the light amount of the reflected light is smaller than the certain value, the controller may determine the floor material includes carpeting. In detail, the floor may have a different degree of reflection of light depending on the material, such that a hard floor may reflect a relatively large amount of light, and the carpeted floor may reflect a relatively small amount of light. Therefore, the controller 100 may determine the material of the floor based on the amount of a light that is output from the light emitting element, reflected from the floor, and received by the light receiving element.

As previously described, if the amount of the detected reflected light is equal to or greater than a certain reference value, the controller 100 may determine that the floor is a hard floor surface, and if the light amount of the reflected light is smaller than the certain reference value, the controller 100 may determine that the floor includes a carpet. In one example, the reference value that is that is used to determine the material of the floor may be set based on a distance between the floor and the cliff sensor 120*a*, 120*b*, such as setting different reference values for different distances between the floor and the cliff sensor 120*a*, 120*b*. For example, a first reference value may be used when the distance from the floor detected by the cliff sensor 120*a* and 120*b* is 25 mm or less, and a second, different reference value may be used when the distance is 35 mm or more.

When the distance from the floor is relatively small (e.g., less than a threshold distance), a significant difference in the amount of reflected light from different floor types (e.g., a hard floor or a carpeted floor) may not be detectable. Therefore, in an example in which the distance from the floor detected by the cliff sensor 120*a*, 120*b* is a certain distance or more, the controller may use the detected distance to determine the reference value used to identify the floor material. For example, the controller 100 may determine the material of the floor based on comparing the amount of reflected light which is detected to a certain threshold value when the distance from the floor to the cliff sensors 120*a*, 120*b* is 20 mm or more.

According to an embodiment of the present application, the controller 100 may determine that the floor surface includes carpeting based on the amount of reflected light detected by the cliff sensor 120*a*, 120*b*, and the floor state may be further determined and/or verified using the amount of reflected light detected by the cliff sensor 120*a*, 120*b* and the current value of a load to the driving motor 38. The drive motor 38 may use more power to rotate the spinning mop 40 when the robot cleaner 10 is positioned on a carpeted floor. Thus, the controller 100 may determine that the robot cleaner 10 is positioned on a carpeted floor when the motor load is greater than or equal to a threshold voltage value, and may determine that the robot cleaner 10 is positioned on a hard floor when the motor load is less than the threshold voltage value. In this way, the floor state may be more accurately identified.

The robot cleaner 10 according to an embodiment may include a controller 100 which measures the slip rate of the spin mop 40 based on the information sensed by the motion detection unit 110, measures the water content rate based on the floor information by the floor detection unit 120 and the slip rate, and controls the rotation speed of the drive motor 38 and the water supply amount outputted by the pump 34 (or released through a water control valve). The robot cleaner 10 according to an embodiment may further include a storage unit (or memory 130) that stores data of a correlation between a slip rate measured with respect to a reference motion and a water content rate identifying the degree to which the rotation mop contains water. Optionally, the storage unit 130 of the robot cleaner 10 may further store data related to a specific correlation between the measured slip rate, information of the floor material, and water content rate. For example, the storage unit 130 may store data identifying floor materials and water content rates associated with different measured slip rates.

The storage unit 130 may also store experimental data experimentally identifying the correlation between the ideal rotation speed of the robot cleaner 10 according to the rotation amount of the spin mop 40 and the actual rotation speed of the robot cleaner 10 measured by the gyro sensor 112. The storage unit 130 may also store experimentally determined data identifying the correlation between the actual straight moving speed (e.g., as measured by the acceleration sensor 114) and the ideal straight moving speed of the robot cleaner 10 even when the robot cleaner 10 performs a straight moving acceleration movement.

The controller 100 may measure the slip rate of the spin mop based on the information sensed by the motion detection unit 110. The controller 100 may measure the slip rate of the spin mop based on the actual speed of the main body 20 measured by the motion detection unit 110 and the ideal speed of the main body 20 estimated according to the driving of the drive motor 38, such as estimating the ideal speed based on the driving power supplied to the drive motor 38. The controller 100 may measure the slip rate of the robot cleaner 10 based on the information sensed by the motion detection unit 110 when the robot cleaner 10 performs a reference motion. Specifically, when the robot cleaner 10 turns, the controller 100 may compare an ideal rotation speed of the robot cleaner 10 according to the rotation amount of the spin mop 40 with an actual rotation speed of the robot cleaner 10 measured by the gyro sensor 112 to calculate a slip rate.

When the robot cleaner 10 moves straight, the controller 100 may compare the ideal straight moving acceleration of the robot cleaner 10 according to the rotation amount of the spin mop 40 with the actual acceleration of the robot cleaner 10 measured by the acceleration sensor 114, and calculate the slip rate. In addition, it is also possible that when the robot cleaner 10 moves, the controller 100 compares the ideal speed of the robot cleaner 10 according to the rotation of the spin mop 40 with the speed of the robot cleaner 10 measured by the encoder (not shown) to calculate the slip rate.

Similar to the above-described method of measuring the slip rate, a method of experimentally determining a correlation between the ideal rotation speed of the robot cleaner 10 according to the rotation amount of the spin mop 40 and the actual rotation speed of the robot cleaner 10 measured by the gyro sensor 112 and estimating a slip rate by using a correlation table, or a method of calculating a slip rate through a slip rate formula by using the ideal rotation speed of the robot cleaner 10 and the measured rotation speed of the robot cleaner 10 may be used. Similarly, even when the robot cleaner 10 performs a relatively straight direction acceleration movement, a method of experimentally defining a correlation between the actual straight moving speed and the ideal straight moving speed of the robot cleaner 10 and estimating a slip rate by using a correlation table, or a method of calculating a slip rate through a slip rate formula by using the ideal straight moving speed of the robot cleaner 10 and the measured straight moving speed of the robot cleaner 10 may be used.

In one example, the controller 100 may determine the water content rate of the robot cleaner 10 based on the material of the floor surface determined by the floor detection unit 120 and the slip rate of the robot cleaner 10 measured in the reference motion. The controller 100 may determine the water content rate based on stored data related to a correlation between the slip rate and the water content rate according to the material of the floor surface determined by the floor detection unit 120.

Typically, as the water content rate becomes higher, a speed closer to the ideal moving speed of the robot cleaner 10 in which no slip occurs may be achieved because the spinning mop 40, when wet, may apply a relatively larger friction force to the floor when rotating. A specific relationship between the water content rate and the slip rate may vary depending on the floor material, which can be determined experimentally.

The robot cleaner 10 according to the present embodiment may further include an input unit (or user interface) 140 that receives an input associated with a user's command. For example, a user may set the traveling method of the robot cleaner 10 or the water content rate of the spin mop 40, through the input unit 140. The input unit 140 may include, for example, a button, keypad, a touch screen, etc.

Figure 6A:
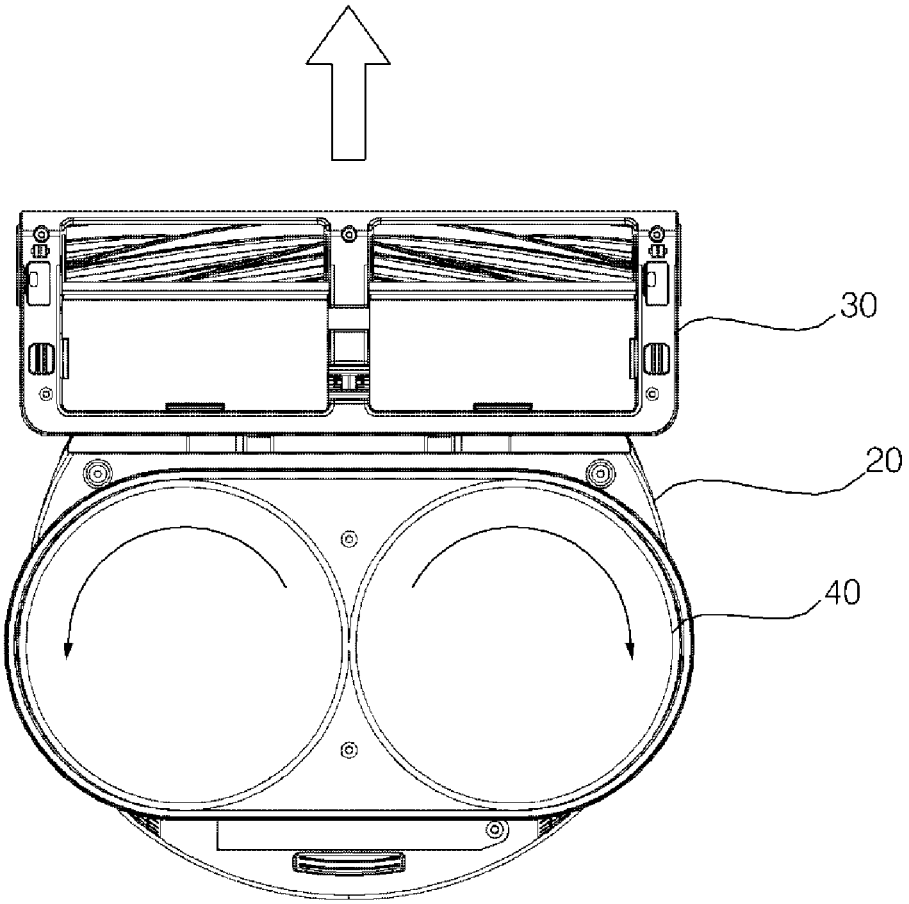
FIG. 6A is a view for explaining rotation of a spin mop when a robot cleaner travels in a forward direction according to an embodiment of the present application.
Figure 6B:
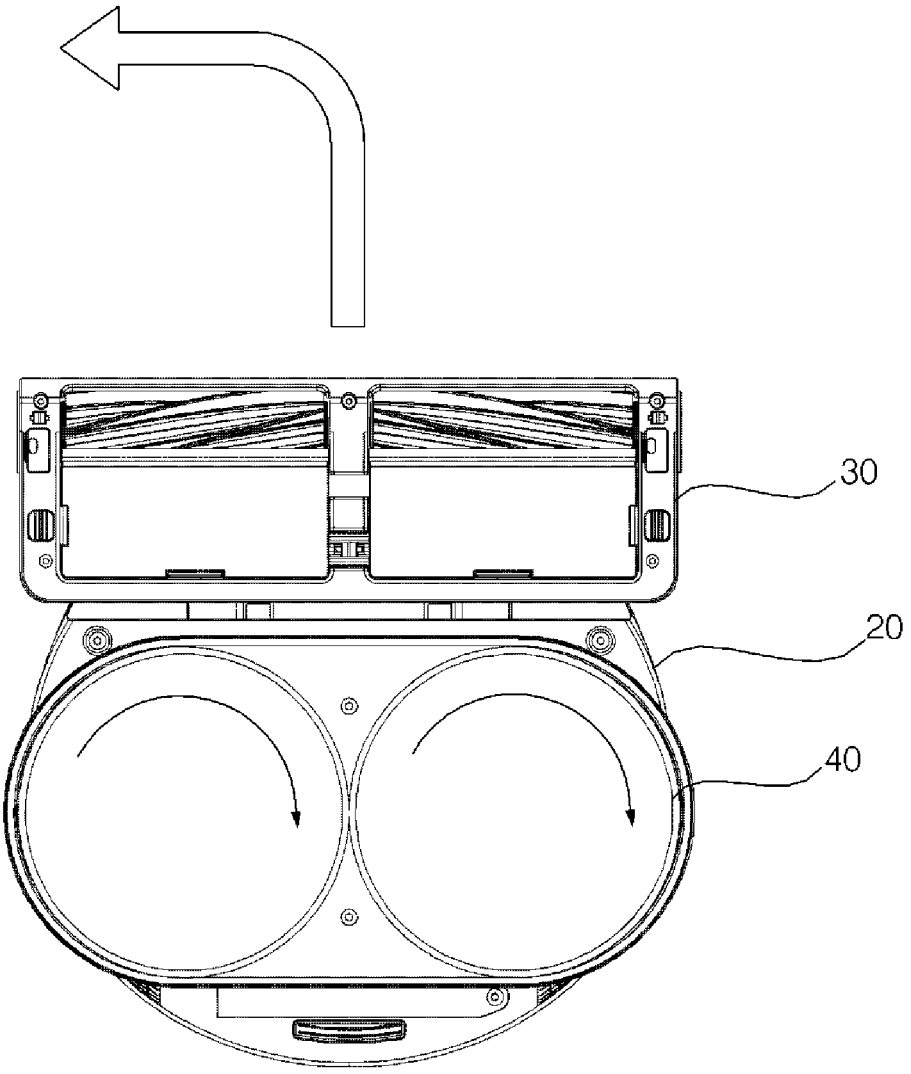
FIG. 6B is a view for explaining rotation of a spin mop when a robot cleaner turns round with a large radius according to another embodiment of the present application.
Figure 6C:
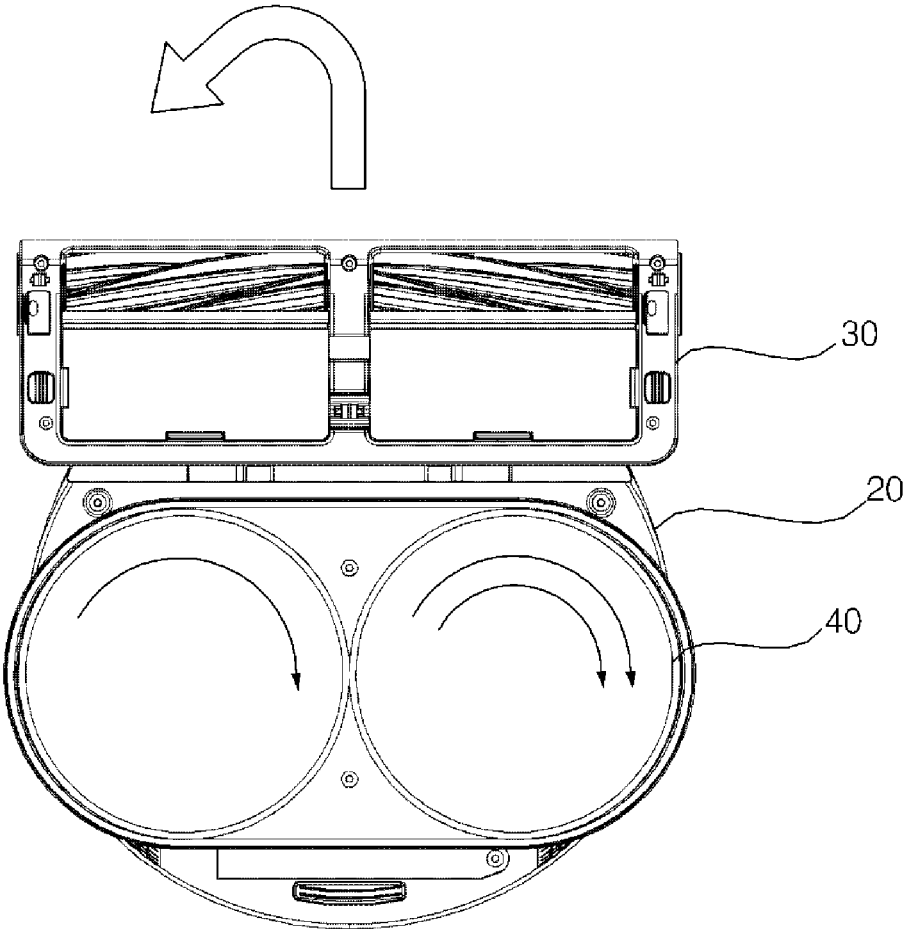
FIG. 6C is a view for explaining rotation of a spin mop when a robot cleaner turns round with a small radius according to another embodiment of the present application.

FIGS. 6A-6C are views related to the motion of the robot cleaner 10 according to an embodiment of the present application. Hereinafter, with reference to FIGS. 6A-6C, a method of determining a slip rate according to the traveling of the robot cleaner due to the rotation of the spin mop and the movement of the robot cleaner will be described.

The robot cleaner 10 according to an embodiment may include a pair of spin mops 40, and may move by rotating the pair of spin mops 40. The robot cleaner 10 may control the traveling of the robot cleaner 10, for example, by varying the rotation direction or rotation speed of each of the pair of spin mops 40.

Referring to FIG. 6A, the straight movement of the robot cleaner 10 may be performed by rotating each of the pair of spin mops 40 in opposite directions. In this case, the rotation speed of each of the pair of spin mops 40 may be substantially the same, but the rotation direction may be different. The robot cleaner 10 may perform a forward movement or a backward movement by changing the rotation direction of both spin mops 40.

Referring to FIGS. 6B and 6C, the robot cleaner 10 may turn when each of the pair of spin mops 40 rotates in the same direction. The robot cleaner 10 may rotate in place or turn along a round path to move curvedly by varying the rotation speed of each of the pair of spin mop 40. The radius of turning round may be adjusted by varying the rotation speed ratio of each of the pair of spin mops 40 of the robot cleaner 10.

Figure 7:
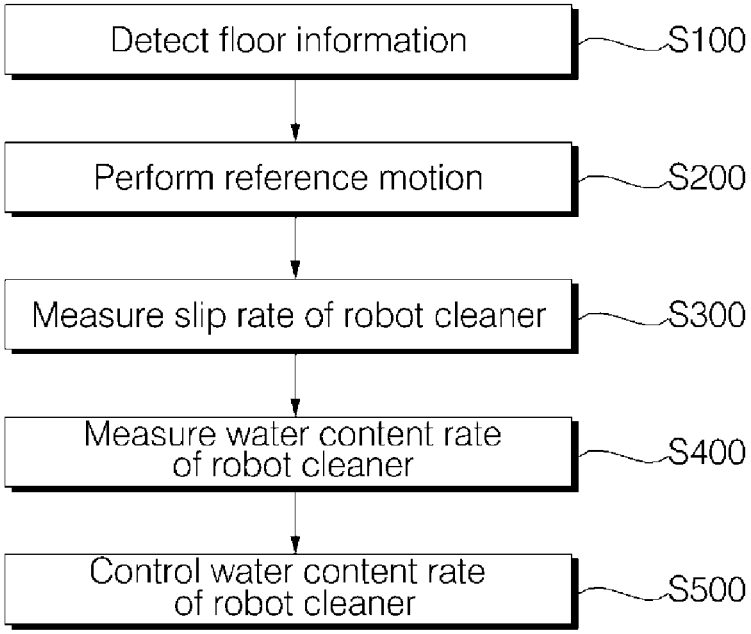
FIG. 7 is a flowchart illustrating a method of measuring and controlling a water content rate of a robot cleaner according to an embodiment of the present application.
Figure 8:
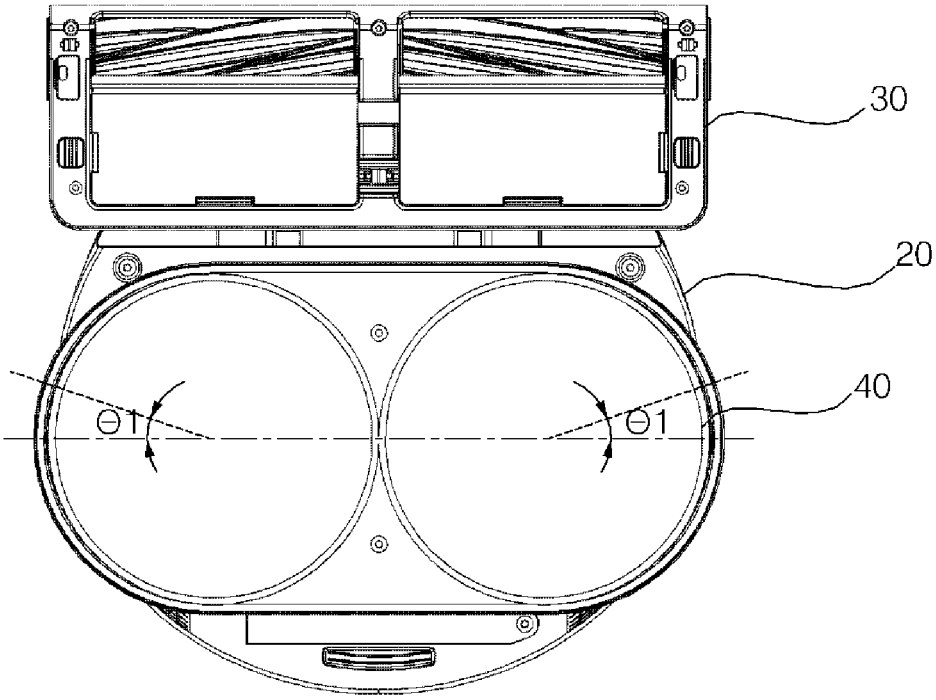
FIG. 8 is a view for explaining a portion of a spin mop of a robot cleaner in contact with a bottom surface according to an embodiment of the present application.
Figure 9:
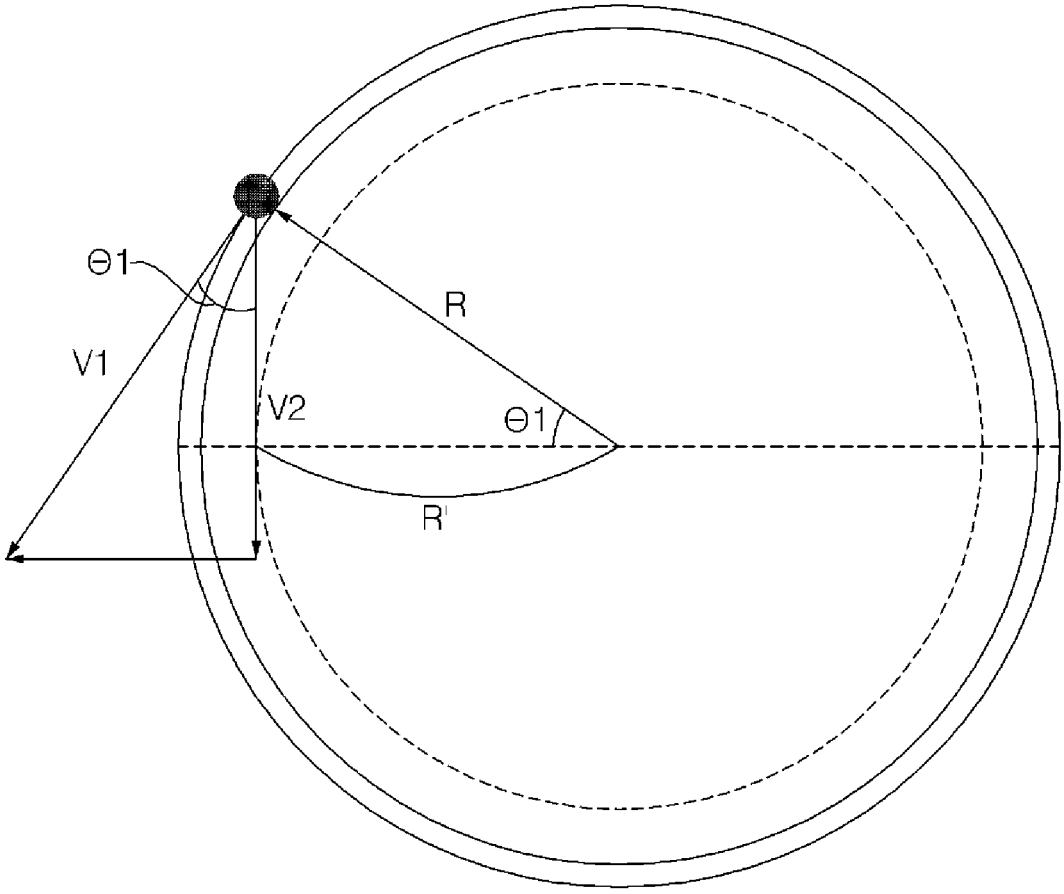
FIG. 9 is a view for explaining a range in which a spin mop is involved in movement of a robot cleaner according to an embodiment of the present application.
Figure 10:
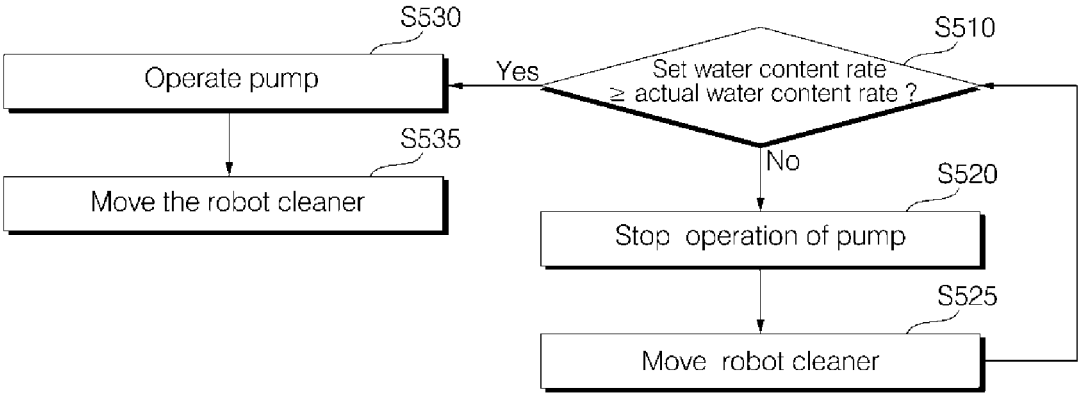
FIG. 10 is a flowchart illustrating a method of controlling a water content rate of a robot cleaner according to an embodiment of the present application.

FIG. 7 is a flowchart illustrating a method of measuring and controlling a water content rate of a robot cleaner 10 according to an embodiment of the present application. FIG. 8 is a view for explaining a portion of a spin mop 40 of a robot cleaner 10 in contact with a bottom surface according to an embodiment of the present application. FIG. 9 is a view for explaining a range in which a spin mop 40 is involved in movement of a robot cleaner 10 according to an embodiment of the present application. FIG. 10 is a flowchart illustrating a method of controlling a water content rate of a robot cleaner 10 according to an embodiment of the present application.

Hereinafter, a method of controlling the water content rate of the robot cleaner 10 according to the present embodiment will be described with reference to FIG. 7 to FIG. 10. The robot cleaner 10 according to one embodiment may detect floor information (S100). The robot cleaner 10 according to the present embodiment may detect the material of the floor surface on which the robot cleaner 10 moves by the floor detection unit 120.

The robot cleaner 10 according to one embodiment may perform a reference motion (S200). The reference motion refers to a motion related to driving the spin mop 40 of the robot cleaner 10 so as to calculate the slip rate of the robot cleaner 10 by using the gyro sensor 112 and/or the acceleration sensor 114. The motion may include at least one of a static motion in which the robot cleaner 10 rotates in place or a moving motion in which the robot cleaner 10 performs a straight movement or a curved path movement. In the step S200 of performing the reference motion, the robot cleaner 10 may travel in a curved path or may travel in a substantially straight path.

When performing the reference motion in step S200 that includes a turning motion, the robot cleaner 10 according to one embodiment may rotate the pair of spin mops 40 in the same direction, so that the robot cleaner 10 can turn. The robot cleaner 10 may rotate in place or may turn the robot cleaner 10 along a curved path by varying the rotation speed of each of the pair of spin mops 40.

When performing the reference motion in step S200 that includes a straight moving acceleration, the robot cleaner 10 according to one embodiment may accelerate the robot cleaner 10 by changing the actual rotation speed of one or more of the spin mops 40. For example, the robot cleaner 10 may accelerate the robot cleaner 10 by differentiating the rotation direction of each of the pair of spin mops 40, and by changing the driving speed of the spin mop 40.

Thereafter, a slip rate of the robot cleaner 10 may be measured (S300). The controller 100 may measure the slip rate based on the actual speed of the main body 20 measured by the motion detection unit 110 in the reference motion and the ideal speed of the main body 20 estimated according to the driving of the drive motor 38. When measuring the slip rate in step S300, the motion of the main body 20 of the robot cleaner 10 and the motion of the rotation mop may be measured, and the slip rate of the robot cleaner 10 may be measured based on the motion measurement information.

When the robot cleaner 10 turns, the controller 100 may measure the slip rate by using the actual rotation speed measured by the gyro sensor 112 and an estimated rotation speed of the robot cleaner 10 corresponding to the rotation of the spin mop 40. When the robot cleaner 10 performs a straight acceleration movement, the controller 100 may measure the slip rate by using the actual moving speed of the robot cleaner measured by the acceleration sensor 114 and an estimated moving speed of the robot cleaner corresponding to the rotation of the spin mop 40.

The slip rate may be obtained by using a method of experimentally defining a correlation between the ideal moving speed of the robot cleaner 10 according to the rotation amount of the spin mop 40 and the actual moving speed of the robot cleaner 10 measured by the motion detection unit 110 and estimating a slip rate by using a correlation table, or a method of calculating a slip rate by applying the ideal moving speed of the robot cleaner 10 and the measured moving speed of the robot cleaner 10 to a slip rate formula. Hereinafter, a method of calculating the slip rate by using the slip rate formula will be described. First, the radius and speed of the spin mop 40 involved in the movement of the robot cleaner 10 will be described, and a method of measuring a corresponding slip rate will be described.

The rotation speed of the robot cleaner 10 may depend on the radius R of the spin mop 40 and the rotation speed of each spin mop 40. As shown in FIG. 8, when a portion in which the spin mop 40 is inclined to the floor surface forms a set angle 81 with respect to a virtual line connecting the centers of the pair of spin mops 40, the radius R' of the spin mop 40 involved in the actual movement may be obtained as shown in the following equation 1 with reference to FIG. 9.

$$R'=R*\cos\theta 1 \quad \text{<Equation 1>}$$

Since a linear speed V1 at a portion where the spin mop 40 is in contact with the floor surface is formed at a portion having a set angle θ1 for the actual traveling of the spin mop 40, a linear speed V2 for the actual traveling direction may be expressed as shown in the following equation 2, $$V2=V1*\cos\theta 1 \quad \text{<Equation 2>}$$

Referring to FIG. 9, a portion perpendicular to the linear speed V2 with respect to the actual traveling direction may be a radius R' of the spin mop 40 involved in the actual movement.

Hereinafter, an embodiment in which the slip rate of the robot cleaner 10 is determined depending on whether the robot cleaner 10 turns or moves straight will be described. The slip rate Sr1 associated with the robot cleaner 10 turning may be calculated based on the following equation 3 by using the ideal rotation speed Rf of the robot cleaner 10 according to the rotation of each of the pair of spin mops 40 and the actual rotation speed Rr measured by the gyro sensor 112.

$$Sr1=(Rf-Rr)/Rf*100 \quad \text{<Equation 3>}$$

The slip ratio Sr2 associated with the robot cleaner 10 moving substantially straight may be obtained by using the acceleration sensor 114. For example, the robot cleaner 10 may compare the ideal speed of the robot cleaner 10 according to the rotation of each of the pair of spin mops 40 with the actual speed of the robot cleaner 10 measured by the acceleration sensor 114, and may calculate the slip rate.

The slip rate Sr2 in the case where the robot cleaner 10 accelerates or decelerate to move may be calculated by the following equation 4 by using the ideal speed Vf of the robot cleaner 10 according to the rotation of each of the pair of spin mops 40 and the actual speed Vr of the robot cleaner 10 measured by the acceleration sensor 114. In the straight movement of the robot cleaner 10, the ideal speed Vf of the robot cleaner may be expressed as the linear speed V2 of the spin mop calculated in the above equation 2. The speed Vr of the robot cleaner 10 measured by the acceleration sensor 114 may be obtained by integrating the acceleration value measured by the acceleration sensor 114.

$$Sr2=(Vf-Vr)/Vf*100 \quad \text{<Formula 4>}$$

In addition, it is also possible to obtain the slip rate by calculating the ratio of the ideal rotation number of the spin mop 40 and the actual rotation number of the spin mop 40 operated by the drive motor 38, in the range of the changed rotation angle determined by the gyro sensor 112.

Continuing with FIG. 7, the water content rate of the robot cleaner 10 may be measured (S400). The controller 100 may measure the water content rate according to the degree of slip rate, based on the data stored in the storage unit 130. The controller 100 may measure the water content rate based on the information on the floor material and the measured slip rate. The controller 100 may measure the water content rate according to the measured slip rate, based on the data on the correlation between the slip rate and the water content rate according to the type of floor detected in the floor information sensing step S100.

Thereafter, the water content rate of the robot cleaner may be controlled based on the measured water content rate (S500). The robot cleaner according to the present embodiment may control the amount of water supplied to the rotation mop of the robot cleaner 10 based on the slip rate measured by performing the reference motion. That is, the water content rate measurement according to one embodiment may be determined based on the slip rate measurement, and the data related to the correlation between the slip rate and the water content rate, and the water content rate of the robot cleaner may be controlled according to the slip rate measurement.

Referring to FIG. 10, the step S500 of controlling the water content rate of the robot cleaner 10 may include a step S510 of comparing a set water content rate with an actual water content rate measured in the above process. The set water content rate may be a water content rate which is previously set before measuring the slip rate. The set water content rate may be set by user's input (e.g., via the input unit 140), or may be set to an experimentally determined water content rate for mopping with a damp cloth. The set water content rate may be changed by the user's input. The actual water content may be an actual water content rate of the robot cleaner and may be calculated based the floor material and the slip rate.

When the actual water content is less than the set water content, the controller 100 may operate a pump (S530) to supply the water stored in a water tank 32 to the spin mop 40. When the robot cleaner omits the pump 34 and includes, instead, a water control valve to regulate a flow of water to the spin mop 40, step S530 may include the controller 100 operating the water control valve to supply the water stored in a water tank 32 to the spin mop 40. Thereafter, the controller 100 may operate the drive motor to move the robot cleaner (S535), and mop the floor with a damp cloth associated with the spin mop 40.

When the actual water content rate is greater than the set water content rate, the controller 100 may stop the operation of the pump 34 (S520), and operate the drive motor to move the robot cleaner 10 (S525). Similarly, when the robot cleaner 10 includes a water control valve to regulate a flow of water to the spin mop 40, step S520 may include the controller 100 controlling the water control valve to reduce or stop a supply of the water stored in the water tank 34 to the spin mop 40. Since the robot cleaner 10 mops the floor with a damp cloth through the rotation mop during the movement process, the water content rate of the rotation mop may be reduced during operation of the rotation mop. The controller 100 may stop the pump operation and move the robot cleaner until the desired set water content rate is measured to be less than the actual water content. Thereafter, when the actual water content rate is less than the set water content rate, the controller 100 may operate the pump to move the robot cleaner 10.

According to the robot cleaner 10 of the present application, one or more of the following aspects may be obtained.

First, the control method of the robot cleaner 10 according to the present application may control the amount of water supplied to the rotation mop by determining the moving motion of the robot cleaner, without a separate water content rate sensor. Second, the control method of the robot cleaner 10 according to the present application can measure and control the water content rate of the rotation mop, and supply an appropriate amount of water to the rotation mop to clean the floor. Third, the robot cleaner 10 according to the present application can determine the slip rate of the robot cleaner 10 according to the floor material, measure the water content rate, supply an appropriate amount of water to the rotation mop, and effectively mop the floor with a damp cloth according to the floor material.

Similarly, an aspect of the present application provides a method of controlling a robot cleaner in which a water content rate of a rotation mop of the robot cleaner is measured without having a water content rate detection sensor. The present application further provides a method of controlling a robot cleaner 10 based on detecting a movement of the robot cleaner and measuring a water content rate of a rotation mop of the robot cleaner.

In accordance with an aspect of the present application, a robot cleaner may include: a main body which forms an external shape; a water tank which stores water; a rotation mop which is in contact with a floor while rotating and moves the main body; a drive motor which rotates the rotation mop; a motion detection unit which measures a reference motion of the main body when the rotation mop rotates; and a controller which measures a slip rate based on an actual speed of the main body measured by the motion detection unit in the reference motion and an ideal speed of the main body estimated according to driving of the drive motor, and controls an amount of water supplied to the rotation mop.

The robot cleaner may further include a floor detection unit which senses information of a floor on which the rotation mop moves. The controller adjusts an amount of water supplied to the rotation mop based on the information of the floor detected by the floor detection unit and the slip rate measured in the reference motion. A speed measured by the motion detection unit includes at least one of a rotation speed of the main body and a straight moving speed of the main body. The motion detection unit is a gyro sensor for measuring a rotation speed of the main body according to rotation of the rotation mop. The controller measures the slip ratio by using an ideal rotation speed of the main body according to the rotation of the rotation mop and an actual rotation speed of the main body measured by the gyro sensor.

The robot cleaner may further include a storage memory unit for storing data related to a correlation between a slip rate measured in the reference motion and a water content rate which is a degree to which the rotation mop contains water. The controller determines an actual water content rate for the measured slip rate from the storage unit, and compares the actual water content rate with a set water content rate to adjust an amount of water supplied to the rotation mop.

In accordance with another aspect of the present application, a method of controlling a robot cleaner may include: (a) performing a reference motion by a robot cleaner which moves a main body by using a rotation mop; (b) measuring a motion of the main body of the robot cleaner and a motion of the rotation mop; (c) measuring a slip rate of the robot cleaner based on information measured in the step (b); and (d) controlling an amount of water supplied to the rotation mop, based on the slip rate measured in the step (c).

The method of controlling a robot cleaner, before the step (d), may further include a step (e) of determining material information of a floor on which the robot cleaner moves. The step (d) may include controlling the amount of water supplied to the rotation mop in consideration of floor material information sensed in the step (e) and the slip rate sensed in the step (c).

The step (d) of controlling an amount of water supplied to the rotation mop may include steps of (d1) measuring a water content rate of the robot cleaner, based on the slip rate measured in the step (c); (d2) comparing a set water content rate with an actual water content rate measured in the step (d1); and (d3) supplying water to the spin mop and driving the spin mop, when the set water content rate is equal to or greater than the actual water content rate.

In another example, the step (d) of controlling an amount of water supplied to the rotation mop may include steps of (d1') measuring a water content rate of the robot cleaner, based on the slip rate measured in the step (c); (d2') comparing a set water content rate with an actual water content rate measured in the step (d1'); and (d3') driving the rotation mop without supplying water to the rotation mop, when the set water content rate is smaller than the actual water content rate.

Hereinabove, although the present application has been described with reference to exemplary embodiments and the accompanying drawings, the present application is not limited thereto, but may be variously modified and altered by those skilled in the art to which the present application pertains without departing from the spirit and scope of the present application claimed in the following claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present application.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the application. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this application belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the application. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A robot cleaner comprising:

a main body;

a water tank which stores water;

a rotation mop which contacts a floor and moves the main body while rotating;

a drive motor which rotates the rotation mop;

a motion sensor which measures a reference motion of the main body while the rotation mop rotates; and a controller which:

calculates a slip rate based on an actual speed of the main body measured by the motion sensor during the reference motion and an ideal speed of the main body which is estimated according to driving of the drive motor, and controls an amount of water supplied to the rotation mop based on the slip rate.

2. The robot cleaner of claim 1, further comprising a floor sensor which senses information of the floor.

3. The robot cleaner of claim 2, wherein the controller adjusts the amount of water supplied to the rotation mop further based on the information of the floor detected by the floor sensor.

4. The robot cleaner of claim 1, wherein a speed measured by the motion sensor includes at least one of a rotation speed of the main body or a straight moving speed of the main body.

5. The robot cleaner of claim 1, wherein the motion sensor includes a gyroscopic sensor that measures a rotation speed of the main body according to rotation of the rotation mop.

6. The robot cleaner of claim 5, wherein the controller calculates the slip ratio further based on an ideal rotation speed of the main body according to the rotation of the rotation mop and an actual rotation speed of the main body measured by the gyroscopic sensor.

7. The robot cleaner of claim 1, further comprising a memory that stores data related to a correlation between at least one slip rate measured during the reference motion and a water content rate identifying a degree to which the rotation mop contains water.

8. The robot cleaner of claim 7, wherein the controller further determines an actual water content rate for the measured slip rate based on the data stored in the memory, and compares the actual water content rate with a set water content rate when adjusting the amount of water supplied to the rotation mop.

9. The robot cleaner of claim 8, wherein the controller further adjusts the amount of water supplied to the rotation mop and drives the rotation mop when the set water content rate is equal to or greater than the actual water content rate.

10. The robot cleaner of claim 8, wherein the controller further drives the rotation mop without supplying additional water to the rotation mop when the set water content rate is less than the actual water content rate.

11. The robot cleaner of claim 1, wherein the motion sensor includes an acceleration sensor which measures a straight moving speed of the main body according to the rotation of the rotation mop.

12. The robot cleaner of claim 1, further comprising a floor sensor which senses information of the floor, wherein the floor sensor includes a cliff sensor which senses a cliff on the floor in a cleaning area, and wherein the cliff sensor includes at least one light emitter and at least one light sensor.

13. The robot cleaner of claim 1, wherein the rotation mop includes a pair of spin mops having a rotation axis perpendicular to the floor.

14. A method of controlling a robot cleaner, the method comprising steps of:

performing a reference motion by the robot cleaner based on rotating a rotation mop;

measuring a motion of the robot cleaner and a motion of the rotation mop;

calculating a slip rate of the robot cleaner based on the motion of the robot cleaner and the motion of the rotation mop; and controlling an amount of water supplied to the rotation mop based on the slip rate.

15. The method of claim 14, wherein:

performing the reference motion includes turning the robot cleaner, and measuring the motion of the robot cleaner includes determining an actual rotation speed of the main body of the robot cleaner using a gyroscopic sensor.

16. The method of claim 15, wherein the slip rate is calculated using an ideal rotation speed of the robot cleaner corresponding to the motion of the rotation mop and the actual rotation speed of the robot cleaner.

17. The method of claim 14, wherein:

performing the reference motion includes turning the robot cleaner, and measuring the motion of the robot cleaner includes determining an ideal rotation number of the spin mop and an actual rotation number of the spin mop operated by a drive motor, in a range of rotation angle of the robot cleaner.

18. The method of claim 14, wherein:

performing the reference motion includes the robot cleaner moving in a direction, and measuring the motion of the robot cleaner includes determines a moving distance of the robot cleaner in the direction.

19. The method of claim 18, wherein the slip rate is calculated using an ideal speed of the robot cleaner according to the motion of the spin mop and a speed of the robot cleaner.

20. The method of claim 14, further comprising:

determining information about a material of the floor, wherein the slip rate of the robot cleaner is further determined based on the information about the material of the floor.

21. The method of claim 20, wherein the amount of water supplied to the rotation mop is controlled further based on the information about the material of floor.

22. The method of claim 14, wherein controlling the amount of water supplied to the rotation mop includes:

determining an actual water content rate of the robot cleaner based on the slip rate;

comparing a set water content rate and the actual water content rate; and supplying water to the spin mop and driving the spin mop when the set water content rate is equal to or greater than the actual water content rate.

23. The method of claim 14, wherein controlling the amount of water supplied to the rotation mop includes:

determining an actual water content rate of the robot cleaner based on the slip rate;

comparing a set water content rate and the actual water content rate; and driving the rotation mop without supplying water to the rotation mop when the set water content rate is smaller than the actual water content rate.

24. The method of claim 23, further comprising:

supplying water to the rotation mop after the actual water content rate becomes less than the set water content rate based on driving the rogation mop.

* * * * *